US011408230B2

(12) United States Patent
Aschenbrenner et al.

(10) Patent No.: US 11,408,230 B2
(45) Date of Patent: Aug. 9, 2022

(54) WELLBORE REAMING SYSTEMS AND DEVICES

(71) Applicant: EXTREME TECHNOLOGIES, LLC, Vernal, UT (US)

(72) Inventors: Joseph Aschenbrenner, Blackfoot, ID (US); Joshua J. Smith, Vernal, UT (US); Gilbert Troy Meier, Vernal, UT (US)

(73) Assignee: EXTREME TECHNOLOGIES, LLC, Vernal, UT (US)

( * ) Notice: Subject to any disclaimer, the term of this patent is extended or adjusted under 35 U.S.C. 154(b) by 0 days.

(21) Appl. No.: 16/755,148

(22) PCT Filed: Oct. 10, 2018

(86) PCT No.: PCT/US2018/055230

§ 371 (c)(1),
(2) Date: Apr. 9, 2020

(87) PCT Pub. No.: WO2019/075076

PCT Pub. Date: Apr. 18, 2019

(65) Prior Publication Data

US 2020/0300044 A1 Sep. 24, 2020

Related U.S. Application Data

(60) Provisional application No. 62/570,163, filed on Oct. 10, 2017.

(51) Int. Cl.
*E21B 10/26* (2006.01)
*E21B 7/28* (2006.01)

(52) U.S. Cl.
CPC ..... *E21B 10/26* (2013.01); *E21B 7/28* (2013.01)

(58) Field of Classification Search
CPC ..... E21B 10/26; E21B 7/28
See application file for complete search history.

(56) References Cited

U.S. PATENT DOCUMENTS

| | | | | |
|---|---|---|---|---|
| 1,489,849 A | | 4/1924 | Sidney et al. | |
| 1,772,491 A | | 8/1930 | Koppl | |
| 3,231,033 A | | 1/1966 | Williams | |
| 3,237,705 A | * | 3/1966 | Williams, Jr. | E21B 10/46 175/406 |
| 3,391,749 A | | 7/1968 | Arnold | |

(Continued)

FOREIGN PATENT DOCUMENTS

| | | |
|---|---|---|
| EP | 219959 A1 | 4/1987 |
| EP | 1039095 A1 | 9/2000 |

(Continued)

OTHER PUBLICATIONS

International Search Report and Written Opinion dated Dec. 20, 2018 for corresponding PCT/US2018/055230.

(Continued)

*Primary Examiner* — Carib A Oquendo
(74) *Attorney, Agent, or Firm* — Patent Law Works, LLP; Craig Buschmann

(57) ABSTRACT

A reamer for increasing the diameter of a wellbore includes an eccentric reamer lobe having at least one cutting blade and a roller, wherein the roller encompasses the circumference of the reamer.

20 Claims, 9 Drawing Sheets

(56) References Cited

U.S. PATENT DOCUMENTS

| | | | | |
|---|---|---|---|---|
| 3,400,773 | A * | 9/1968 | Castela | E21B 10/28 175/107 |
| 3,561,549 | A | 2/1971 | Garrison | |
| 3,575,247 | A | 4/1971 | Feenstra | |
| 3,851,719 | A | 12/1974 | Thompson | |
| 3,916,998 | A * | 11/1975 | Bass, Jr. | E21B 17/1078 166/301 |
| 3,982,594 | A | 9/1976 | Berthiaume | |
| 4,080,010 | A | 3/1978 | Young | |
| 4,156,374 | A | 5/1979 | Shwayder | |
| 4,385,669 | A | 5/1983 | Knutsen | |
| 4,610,307 | A | 9/1986 | Jurgens | |
| 4,729,438 | A | 3/1988 | Walker | |
| 4,807,708 | A | 2/1989 | Forrest | |
| 4,989,681 | A | 2/1991 | Lohmuller et al. | |
| 5,186,265 | A | 2/1993 | Henson | |
| 5,372,351 | A | 10/1994 | Oliver | |
| 5,495,899 | A | 3/1996 | Pastusek | |
| 5,497,842 | A | 3/1996 | Pastusek | |
| 5,667,027 | A | 9/1997 | Poffenroth | |
| 5,735,359 | A | 4/1998 | Lee | |
| 5,765,653 | A | 6/1998 | Doster | |
| 5,957,223 | A | 9/1999 | Doster | |
| 5,992,548 | A | 11/1999 | Silva | |
| 6,039,130 | A | 3/2000 | Pruet | |
| RE36,817 | E | 8/2000 | Pastusek | |
| 6,109,374 | A | 8/2000 | Burca et al. | |
| 6,116,356 | A | 9/2000 | Doster | |
| 6,213,226 | B1 | 4/2001 | Eppink et al. | |
| 6,227,312 | B1 | 5/2001 | Eppink et al. | |
| 6,257,279 | B1 | 7/2001 | Peltz | |
| 6,386,302 | B1 | 5/2002 | Beaton | |
| 6,397,958 | B1 | 6/2002 | Charles | |
| 6,488,104 | B1 | 12/2002 | Eppink | |
| 6,494,272 | B1 | 12/2002 | Eppink | |
| 6,607,371 | B1 | 8/2003 | Raymond et al. | |
| 6,609,580 | B2 | 8/2003 | Beaton | |
| 6,622,803 | B2 | 9/2003 | Harvey | |
| 6,695,080 | B2 | 2/2004 | Presley et al. | |
| 6,732,817 | B2 | 5/2004 | Dewey | |
| 6,920,944 | B2 | 7/2005 | Eppink | |
| 6,973,974 | B2 | 12/2005 | McLoughlin | |
| 6,991,046 | B2 | 1/2006 | Fielder | |
| 7,650,952 | B2 | 1/2010 | Evans | |
| 7,901,137 | B1 | 3/2011 | Peterson | |
| 8,752,649 | B2 | 6/2014 | Isenhour | |
| 8,813,877 | B1 | 8/2014 | Short | |
| 8,851,205 | B1 | 10/2014 | Short | |
| 9,145,746 | B1 | 9/2015 | Smith | |
| 9,163,460 | B2 | 10/2015 | Isenhour | |
| 9,273,519 | B2 | 3/2016 | Smith | |
| 9,739,092 | B2 | 8/2017 | Isenhour | |
| 2001/0045306 | A1 | 11/2001 | Fielder et al. | |
| 2002/0020526 | A1 | 2/2002 | Male et al. | |
| 2002/0056574 | A1 | 5/2002 | Harvey | |
| 2002/0125047 | A1 | 9/2002 | Beaton | |
| 2002/0166703 | A1 | 11/2002 | Presley | |
| 2003/0173114 | A1 | 9/2003 | Presley | |
| 2003/0221873 | A1 | 12/2003 | Beaton | |
| 2004/0099448 | A1 | 5/2004 | Fielder et al. | |
| 2004/0206552 | A1 | 10/2004 | Beaton | |
| 2006/0207801 | A1 | 9/2006 | Clayton | |
| 2007/0163810 | A1 | 7/2007 | Underwood et al. | |
| 2010/0018779 | A1 | 1/2010 | Makkar | |
| 2010/0078216 | A1 | 4/2010 | Radford | |
| 2010/0089659 | A1 | 4/2010 | Chafai | |
| 2010/0116556 | A1 | 5/2010 | Buske | |
| 2011/0127044 | A1 | 6/2011 | Radford | |
| 2011/0220416 | A1 | 9/2011 | Rives | |
| 2012/0057814 | A1 | 3/2012 | Dodson | |
| 2012/0255786 | A1 | 10/2012 | Isenhour | |
| 2012/0279784 | A1 | 11/2012 | Harvey | |
| 2013/0180779 | A1 | 7/2013 | Isenhour | |
| 2013/0233620 | A1 | 9/2013 | Rankin | |
| 2014/0064646 | A1 | 3/2014 | Meier | |
| 2014/0131111 | A1 | 5/2014 | Desmette | |
| 2015/0129309 | A1 * | 5/2015 | Anderson | E21B 17/1078 175/57 |
| 2017/0198527 | A1 | 7/2017 | Delwiche et al. | |
| 2017/0241207 | A1 | 8/2017 | Meier et al. | |
| 2019/0226285 | A1 | 7/2019 | Teodorescu et al. | |

FOREIGN PATENT DOCUMENTS

| | | |
|---|---|---|
| WO | 2008026011 | 3/2008 |
| WO | 2009123918 A2 | 10/2009 |
| WO | 2014138844 A1 | 9/2014 |

OTHER PUBLICATIONS

Third Party Submission of References filed in unrelated U.S. Appl. No. 16/256,690. The submission provides a concise description of the noted references relative to U.S. Appl. No. 16/256,690, filed Jan. 24, 2020.

International Patentability Report for PCT/US13/050205 dated Dec. 23, 2013.

International Patentability Report for PCT/US12/58573 dated Jan. 22, 2013.

Schlumberger Oilfield Glossary entry for "borehole", accessed Aug. 12, 2013 via www.glossary.oilfield.slb.com.

Schlumberger Oilfield Glossary entry for "Ream" and "Underreamer", accessed May 22, 2013 via www.glossary.oilfield.slb.com.

PCT/US2012/032714; Search Report in International Patent Application of Isenhour, James; dated Jun. 20, 2012.

Plaintiff's Complaint; *James D. Isenhour, Hard Rock Solutions Inc* vs *Lot William Short, Jr., Short Bit & Tool Co.*, Civil Action No. 11CV1305, Colorado District Court, Larimer County; Oct. 4, 2011.

Plaintiff's First Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Oct. 4, 2011.

Plaintiff's Second Amended Complaint; *James D. Isenhour, Hard Rock Solutions Inc.* vs *Lot William Short, Jr., Short Bit & Tool Co.*, Civil Action No. 11CV1305, Colorado District Court, Larimer County; Jun. 1, 2012.

Defendant's Answer to Plaintiff Second Amended Complaint & Counterclaims; *James D. Isenhour, Hard Rock Solutions Inc.* vs *Lot William Short, Jr., Short Bit & Tool Co.*, Civil Action No. 11CV1305, Colorado District Court, Larimer County; Jun. 15, 2012.

European Extended Search Report dated Oct. 13, 2015 for corresponding European Application No. 12865063.7.

Plaintiff's Reply to Counterclaim and Answer to Cross Claim; *James D. Isenhour, Hard Rock Solutions Inc.* vs *Lot William Short, Jr., Short Bit & Tool Co.*, Civil Action No. 11CV1305, Colorado District Court, Larimer County; Jun. 25, 2012.

Defendant's Initial Disclosures; *James D. Isenhour, Hard Rock Solutions Inc.* vs *Lot William Short, Jr., Short Bit & Tool Co.*, Civil Action No. 11CV1305, Colorado District Court, Larimer County; Jun. 30, 2012.

Plaintiff's Disclosure Statement; *James D. Isenhour, Hard Rock Solutions Inc.* vs *Lot William Short, Jr., Short Bit & Tool Co.*, Civil Action No. 11CV1305, Colorado District Court, Larimer County; Aug. 2, 2012.

Short Bit & Tool Co.; Photograph of TCS Reamer; Apr. 2011.

Short Bit & Tool Co.; Photograph of BCS Tandem and TCS Reamer; Feb. 11, 2011.

Baker Hughes; "RWD2 Ream-While-Drilling"; http://www.bakerhughes.com/products-and-services/drilling/d rill-bit-systems/hole-enlargemenUrwd2-ream-while-drilling; 2012.

OTS International; "TPXR Eccentric Reamers"; http://www.otsintl.com/tpxr.asp; 2012.

OTS International; "TPXR Eccentric Tool for Underreaming Operations"; http://www.otsintl.com/TPXR.pdf; 2012.

Schlumberger; "Diamond-Enhanced Insert Reamer" http://www.slb.com/services/drilling/tools_services/reamers_stabilizers/diamond_enhanced_reamer.a spx;2012.

(56) References Cited

OTHER PUBLICATIONS

National Oilwell Varco; "Eccentric String Tools (ES)" http://www.nov.com/Brands/ReedHvcaloq/Eccentric Stnnq Tools.aspx; 2012.
Stabil Drill; "Ghost Reamer"; http://www.stabildrill.com/products/ghost_reamer/; 2011.
Schlumberger; "Quad-D Reamer"; http://www.slb.com/services/drilling/tools services/underreamers/quad d reamer.aspx; 2012.
OTS International; "TP Bits"; http://www.otsintl.com/tp.asp; 2012.
OTS International; "TP Series Hyper-Stable PDC Bits"; http://www.otsintl.com/TP-Series-Bits.pdf; 2012.
National Oilwell Varco; "NOV Downhole—Right Tool, Right Place, Right Time" catalog; http://www.petroleumclub.ro/downloads/07 Tony Watts NOV ReedHycalog.pdf; 2012.
Offshore; "Drilling Operations, Reaming-while-drilling keys effort to reduce tripping of long drillstrings"; http://www.offshore-mag.com/articles/prinUvolume-56/issue-4/departments/drilling-production/drilling-operations-reaming-while-drilling-keys-effort-to-reduce-tripping-of-long-drillstrings.html; 2012.
Varel International; "Hole Opening Bits—Bicenter Technology"; http://www.varelintl.com/Oil and Gas Home/PDC Drill Bits/Hole Opener Bicenter Bits/; 2012.
OMNI Oil Technologies; "Group II—OMNI Versaltile Drilling Reamer/Stabilizer"; http://www.omnioiltech.com/qroup2.php; 2012.
Tercel Oilfield Products; "Versatile Drilling Reamer (VDR)"; http://www.terceloilfield.com/en/drilling-enhancement-vd r. php; 2012.
Sep. 3, 2019 Office Action issued in CN 201810945033.1.
Dictionary definition of "similar", accessed May 22, 2013 via thefreedictionary.com.
Schlumberger Oilfield Glossary entry for "measurements while drilling" accessed Mar. 25, 2019 via www.glossary.oilfield.slb.com.
Hal Edwards et al., SPE 158920—Modeling System Improves Salt Drilling Technique with Concentric Reamer/RSS, Deepwater GOM (SPE Annual Technical Conference and Exhibition held San Antonio, TX Oct. 8-10, 2012) (also available at onepetro.org).
Uyen Partin, et al IADC/SPE 128161—Advanced Modeling Technology: Optimizing Bit-Reamer Interaction Leads to Performance Step-Change in Hole Enlargement While Drilling (IADC/SPE Drilling Conference held New Orleans, LA, Feb. 2-4, 2010)(also available at onepetro.org).
Short Bit & Tool Co.; Invoice No. D143 to Questar E&P Corp.; Aug. 12, 2009.
Short Bit & Tool Co.; Photographs of BCS Reamer; Aug. 2009.
Short, L.W.; "Bicenter Sub" email; Jun. 19, 2010.
Short Bit & Tool Co.; Invoice No. E-279 to Questar E&P; Nov. 1, 2010.
Short Bit & Tool Co.; Photographs of TCS Reamer; Nov. 8, 2010.
PCT Search Report and Written Opinion for PCT App. No. PCT/US18/050208 dated Nov. 8, 2018.
Chinese Office Action dated Jan. 3, 2018 for Appln No. 201280024633.5.
International Search Report and Written Opinion dated Nov. 8, 2018 for corresponding PCT/US2018/050208.
Non-Final Office Action dated Sep. 24, 2020 for U.S. Appl. No. 16/126,394.
Chinese Office Action issued for Chinese Patent Application No. 201880075298.9, dated Aug. 24, 2021 from the China National Intellectual Property Administration, 15 pgs.
Office Action issued by the China National Intellectural Property Administration for Invention No. 201880075298.9, dated Mar. 1, 2022, 12 pgs.

* cited by examiner

WELLBORE REAMING SYSTEMS AND DEVICES

REFERENCE TO EARLIER FILED APPLICATIONS

This application is the National Stage of International Application No. PCT/US2018/055230, filed Oct. 10, 2018; which claims priority to U.S. Provisional Patent Application No. 62/570,163 filed Oct. 10, 2017, entitled "WELLBORE REAMING SYSTEMS AND DEVICES" which are specifically incorporated by reference in their entirety herein.

BACKGROUND OF THE INVENTION

Field of the Invention

The present invention relates to methods and apparatus for drilling wells and, more particularly, to a reamer and corresponding method for enlarging the drift diameter and improving the well path of a wellbore.

Description of the Related Art

Extended reach wells are drilled with a bit driven by a down hole motor that can be steered up, down, left, and right. Steering is facilitated by a bend placed in the motor housing above the drill bit. Holding the drill string in the same rotational position, such as by locking the drill string against rotation, causes the bend to consistently face the same direction. This is called "sliding". Sliding causes the drill bit to bore along a curved path, in the direction of the bend, with the drill string following that path as well.

Repeated correcting of the direction of the drill bit during sliding causes friction between the wellbore and the drill string greater than when the drill string is rotated. Such corrections form curves in the well path known as "doglegs". For example, the drill string presses against the inside of each dogleg turn, causing added friction. These conditions can limit the distance the wellbore can be extended within the production zone and can also cause problems getting the production string through the wellbore.

Similar difficulties can also occur during conventional drilling, with a conventional drill bit that is rotated by rotating the drill string from the surface. Instability of the drill bit can cause a spiral or other tortuous path to be cut by the drill bit. This causes the drill string to press against the inner surface of resulting curves in the wellbore and can interfere with extending the wellbore within the production zone and getting the production string through the wellbore.

When a dogleg, spiral path or tortuous path is cut by a drill bit, the relatively unobstructed passageway following the center of the wellbore has a substantially smaller diameter than the wellbore itself. This relatively unobstructed passageway is sometimes referred to as the "drift" and the nominal diameter of the passageway is sometimes referred to as the "drift diameter". The "drift" of a passageway is generally formed by wellbore surfaces forming the inside radii of curves along the path of the wellbore. Passage of pipe or tools through the relatively unobstructed drift of the wellbore is sometimes referred to as "drift" or "drifting".

In general, to address these difficulties the drift diameter has been enlarged with conventional reaming techniques by enlarging the diameter 16 of the entire wellbore. See FIG. 1*a*. Such reaming has been completed as an additional step, after drilling is completed. Doing so has been necessary to avoid unacceptable increases in torque and drag during drilling. Such additional reaming runs add considerable expense and time to completion of the well. Moreover, conventional reaming techniques frequently do not straighten the well path, but instead simply enlarge the diameter of the wellbore.

When rotary tools are used inside a bore there is a dynamic effect called "whirl" that can occur. This is a secondary mode of motion different from the spinning of the tool, but driven by the rotation of the tool. Whirl is caused when the tool begins to roll around the inner diameter of the wellbore very rapidly in tight eccentric orbits, often with multiple orbits per each revolution of the tool. Large radial forces develop that cause radial impact damage to the tool's cutters. These tools are often used in vertical and horizontal orientations, but the vertical orientation is the most susceptible to whirl. In horizontal applications the weight of the tool helps keep the tool to one side (the bottom). Whirl is a deleterious effect at the drill bit as well. In existing eccentric reaming tools, two eccentric reamers are opposed and spaced apart from each other, so in a whirl mode the two reamers hand off the radial forces to each other as the tool rolls around.

Therefore, there is a need for a reaming device that is able to reduce whirl while still conditioning the well bore.

SUMMARY OF THE INVENTION

To address these needs, the invention provides a method and apparatus for increasing the drift diameter and improving the well path of the wellbore. This is accomplished, in one embodiment, by cutting away material primarily forming surfaces nearer the center of the drift. Doing so reduces applied power, applied torque and resulting drag compared to conventional reamers that cut into all surfaces of the wellbore.

One embodiment of the invention is directed to a reamer for increasing the diameter of a wellbore. The reamer comprises an eccentric reamer lobe having at least one cutting blade and a roller, wherein the roller encompasses the circumference of the reamer.

Preferably, the lobe is positioned to urge at least one cutting blade into engagement with the surface of the wellbore nearest a center of drift of the wellbore. In a preferred embodiment, the roller is adapted to provide an opposing force to a force acting on the lobe. Preferably, the reamer is positioned at least 100 feet behind a drill bit. The reamer preferably further comprises a drill string to which the reamer is coupled.

In a preferred embodiment, each of the at least one cutting blades comprises a plurality of cutting teeth. Preferably, the plurality of cutting teeth extend tangentially to the reamer. Preferably, the teeth of each of the at least one cutting blades are offset from the teeth of an adjacent cutting blade. Preferably, each tooth is comprised of carbide or diamond. In a preferred embodiment, the teeth face the direction of rotation. The teeth of each of the at least one cutting blades are preferably longitudinally overlapping from the teeth of the adjacent cutting blades.

Preferably, each of the at least one cutting blades extends along a spiral path on a portion of the outer surface of the lobe, wherein the spiral path traverses an acute angle relative to the longitudinal axis of the reamer. Preferably, each of the at least one cutting blades extends parallel or at an angle to an axis of the reamer. In a preferred embodiment, the lobe and the roller work in conjunction to limit whirl during drilling. The roller is preferably comprised of an abrasive material. Preferably, the roller further comprises grooves in an outer surface.

Another embodiment of the invention is directed to a drill string. The drill string comprises a bottom hole assembly and a reamer. The reamer comprises an eccentric reamer lobe having at least one cutting blade, and a roller, wherein the roller encompasses the circumference of the reamer.

In a preferred embodiment, the reamer is positioned at least 100 feet behind the bottom hole assembly. Preferably, the bottom hole assembly comprises a drill bit. Preferably, the lobe is positioned to urge at least one cutting blade into engagement with the surface of the wellbore nearest a center of drift of the wellbore. The roller is preferably adapted to provide an opposing force to a force acting on the lobe.

Preferably, each of the at least one cutting blades comprises a plurality of cutting teeth. Preferably, the plurality of cutting teeth extend tangentially to the reamer. In a preferred embodiment, the teeth of each of the at least one cutting blades are offset from the teeth of an adjacent cutting blade. Preferably, each tooth is comprised of carbide or diamond. Preferably, the teeth face the direction of rotation. Preferably, the teeth of each of the at least one cutting blades are longitudinally overlapping from the teeth of the adjacent cutting blades.

In a preferred embodiment, each of the at least one cutting blades extends along a spiral path on a portion of the outer surface of the lobe, wherein the spiral path traverses an acute angle relative to the longitudinal axis of the reamer. Preferably, each of the at least one cutting blades extends parallel or at an angle to an axis of the reamer. Preferably, the lobe and the roller work in conjunction to limit whirl during drilling. Preferably, the roller is comprised of an abrasive material. Preferably, the roller further comprises grooves in an outer surface.

Other embodiments and advantages of the invention are set forth in part in the description, which follows, and in part, may be obvious from this description, or may be learned from the practice of the invention.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, specific details, and the like have been omitted inasmuch as such details are not considered necessary to obtain a complete understanding of the present invention, and are considered to be within the understanding of persons of ordinary skill in the relevant art.

Figure 1:
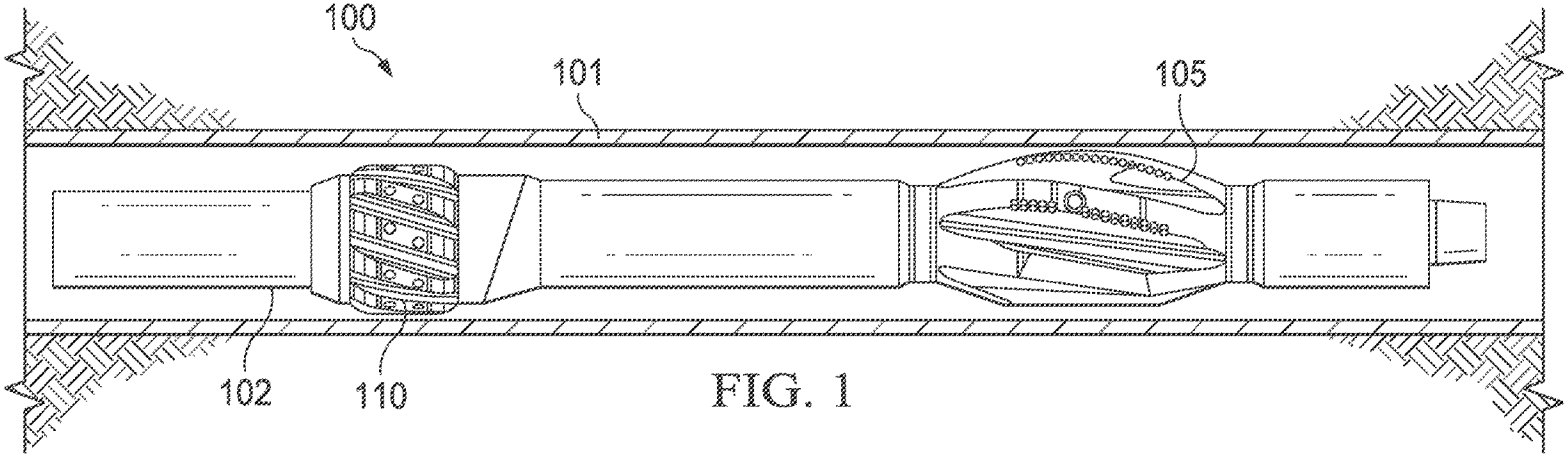
FIG. 1 is a side view of an embodiment of a reamer.

FIG. 1 depicts a side view of an embodiment of an inventive reamer 100. Reamer 100 is preferably adapted to fit within drill string 102. Preferably, reamer 100 is comprised of an eccentric lobe 105 and a roller 110. As shown in the figure, the right side of the figure represents the down-hole portion of the wellbore 101 as the well is drilled and the left side of the figure represents the up-hole potion of wellbore 101. Preferably eccentric lobe 105 is positioned down-hole on reamer 100 while roller 110 is positioned up-hole on reamer 100. However, the two may be reversed. Additionally, two or more lobes 105 and/or rollers 110 may be included in reamer 100. Reamer 100 is preferably positioned to run behind a bottom hole assembly (BHA). In one embodiment, for example, reamer 100 may be positioned within a range of approximately 100 to 150 feet from the BHA.

Figure 2:
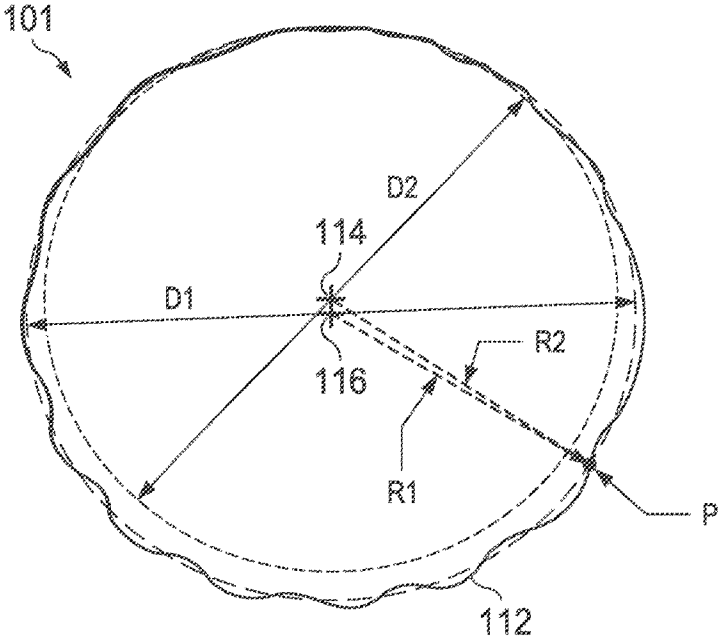
FIG. 2 is a representation of a wellbore illustrating drift diameter relative to drill diameter.
Figure 3:
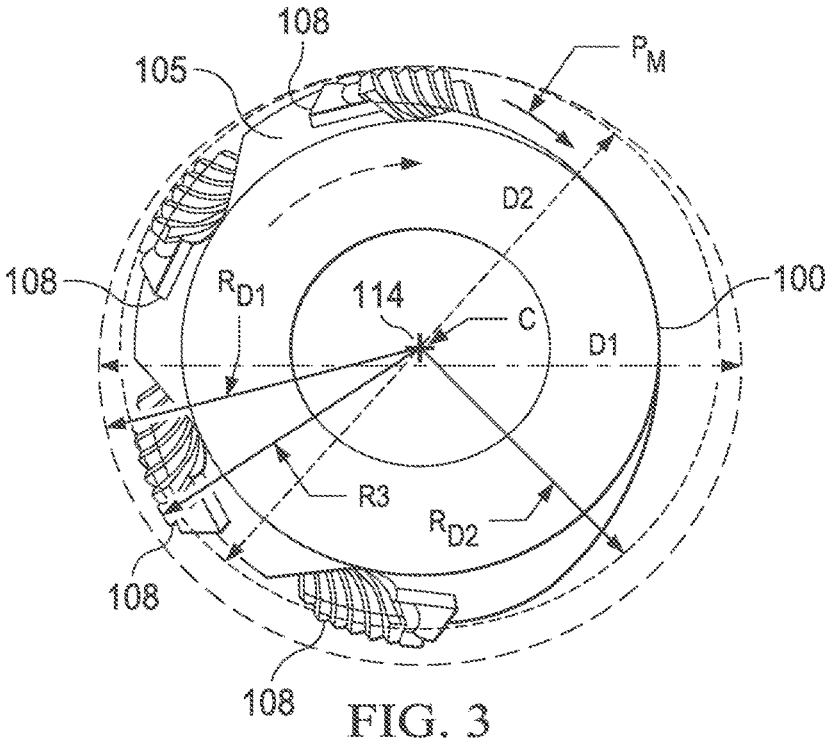
FIG. 3 is a representation an eccentric reamer in relation to the wellbore shown in FIG. 2.

As shown in FIG. 2, the wellbore 101 may have a drill diameter D1 of 6 inches and a drill center 116. The wellbore 101 may have a drift diameter D2 of 5⅝ inches and a drift center 114. The drift center 114 may be offset from the drill center 116 by a fraction of an inch. Any point P on the inner surface 112 of the wellbore 101 may be located at a certain radius R1 from the drill center 116 and may also be located at a certain radius R2 from the drift center 114. As shown in FIG. 3, in which reamer 100 is shown having a threaded center C superimposed over drift center 114, lobe 105 preferably has an outermost radius R3, generally in the area of its teeth 108, less than the outermost radius $R_{D1}$ of the wellbore. However, the outermost radius R3 of lobe 105 is preferably greater than the distance $R_{D2}$ of the nearer surfaces from the center of drift 114. The cutting surfaces of lobe 105 preferably comprise a number of carbide or diamond teeth 108, with each tooth preferably having a circular cutting surface generally facing the path of movement $P_M$ of the tooth relative to the wellbore as the reamer rotates and the drill string advances down hole.

In FIG. 1, the teeth of lobe 105 begins to engage and cut a surface nearer the center of drift off the wellbore 101 shown. As will be appreciated, the teeth of lobe 105, when rotated, cuts away portions of the nearer surface of the wellbore 101, while cutting substantially less or none of the surface farther from the center of drift, generally on the opposite side of the well. Reamer 100 is preferably spaced from the BHA and any other reamer to allow the centerline of the pipe string adjacent the reamer to be offset from the center of the wellbore toward the center of drift or aligned with the center of drift.

Figure 4:
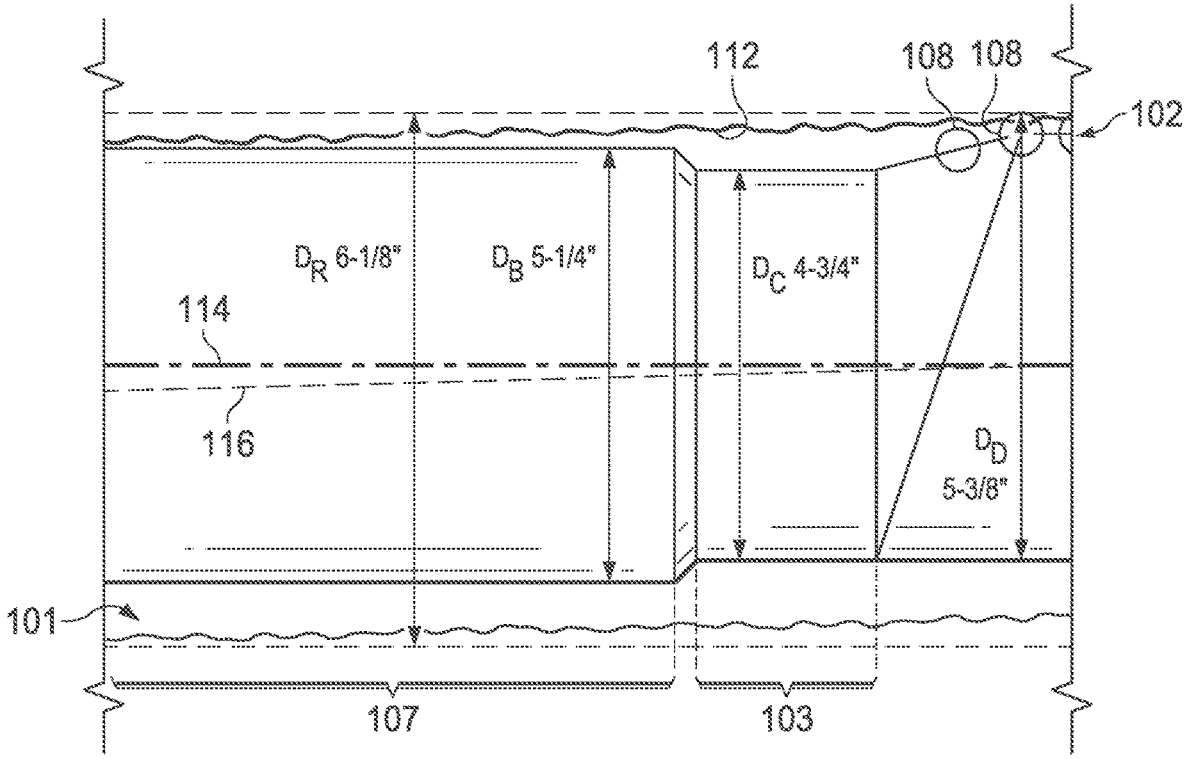
FIG. 4 is a magnification of the downhole portion of the reamer.

FIG. 4 is a magnification of the downhole portion of lobe 105 as the reamer advances to begin contact with a surface 112 of the wellbore 101 nearer the center of drift 114. As the reamer 100 advances and rotates, the existing hole is widened along the surface 112 nearer the center of drift 114, thereby widening the drift diameter of the hole. In an embodiment, a body portion 107 of the drill string 102 may have a diameter $D_B$ of 5¼ inches, and may be coupled to a cylindrical portion 103 of reamer 100, the cylindrical portion 103 having a diameter Dc of approx. 4¾ inches. In an embodiment, the reamer 100 may have a "DRIFT" diameter $D_D$ of 5⅜ inches, and produce a reamed hole having a diameter $D_R$ of 6⅛ inches between the reamed surfaces (represented by the dotted lines in FIG. 4). It will be appreciated that the drill string 102 and reamer 100 advance through the wellbore 101 along a path generally following the center of drift 114 and displaced from the center 116 of the existing hole.

Figure 5:
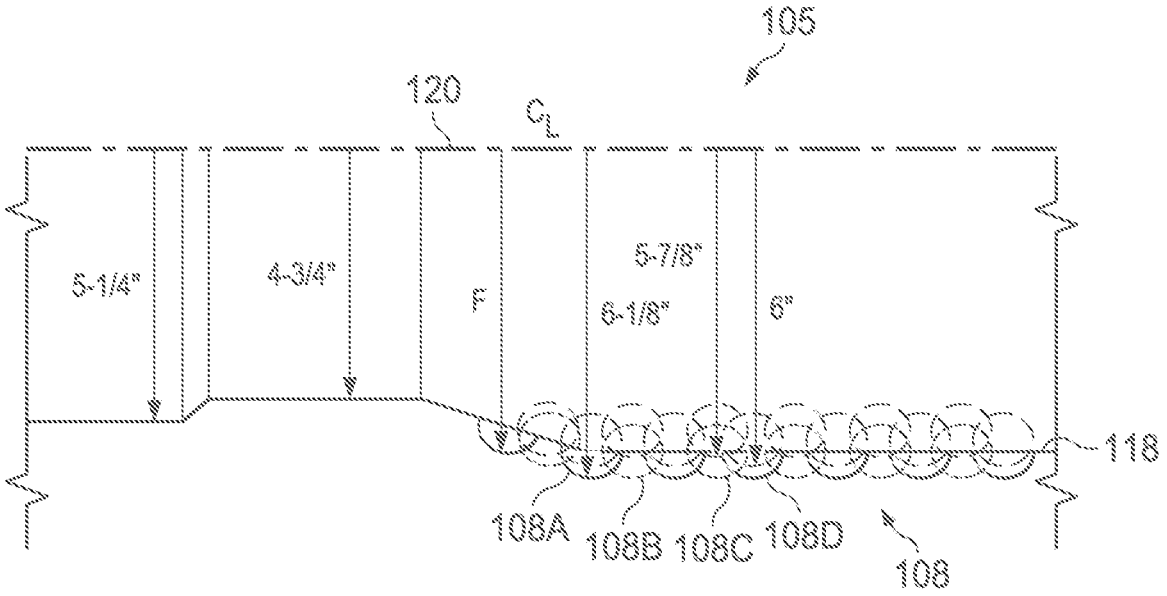
FIG. 5 is illustrates the layout of teeth along a downhole portion of the reamer illustrated in FIG. 1.

FIG. 5 illustrates the layout of teeth 108 along a downhole portion of lobe 105 illustrated in FIG. 1. Four sets of teeth 108, sets 108A, 1086, 108C and 108D, are angularly separated about the exterior of lobe 105. While four sets of teeth are shown, lobe 105 may have one set of teeth, two sets of teeth, three sets of teeth, five sets of teeth, or another number of sets of teeth. FIG. 5 shows the position of the teeth 108 of each set as they pass the bottom-most position shown in FIG. 1 when reamer 100 rotates. As reamer 100 rotates, sets 108A, 108B, 108C and 108D pass the bottom-most position in succession. The sets 108A, 1086, 108C and 108D of teeth 108 are arranged on a substantially circular surface 118 having a center 120 eccentrically displaced from the center of rotation of the drill string 102.

Figure 6:
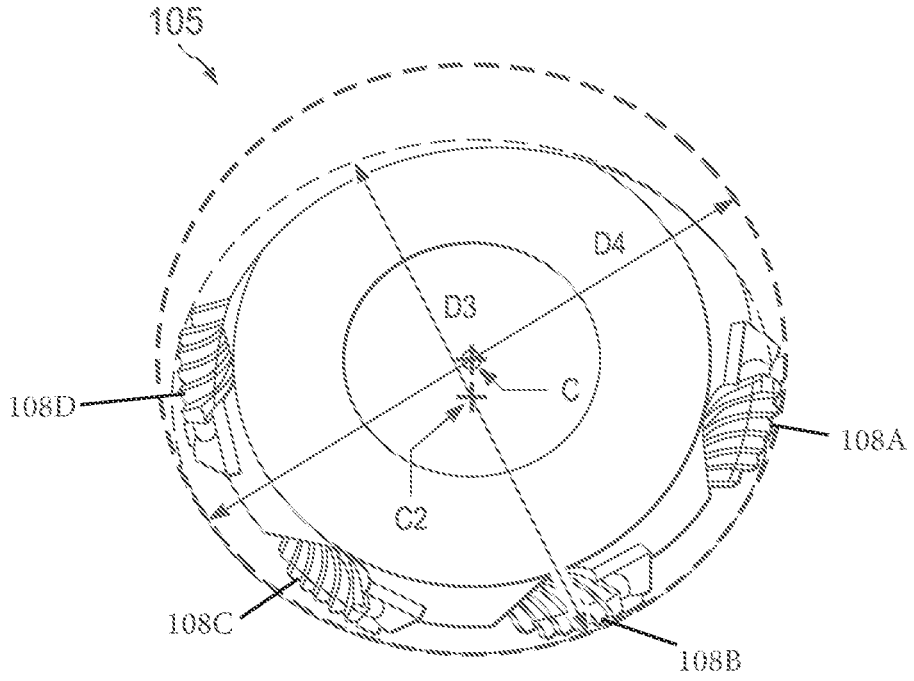
FIG. 6 is an end view of an eccentric reamer illustrating the eccentricity of the reamer in relation to a wellbore diameter.

Each of the sets 108A, 108B, 108C and 108D of teeth 108 is preferably arranged along a spiral path along the surface of lobe 105, with the downhole tooth leading as the reamer 100 rotates (e.g., see FIG. 6). In other embodiments each set of teeth may extend straight and parallel to or at an angle to the axis of the reamer. Sets 108A and 108B of the reamer teeth 108 are preferably positioned to have outermost cutting surfaces forming a 6⅛ inch diameter path when the pipe string 102 is rotated. The teeth 108 of set 108B are preferably positioned to be rotated through the bottom-most point of lobe 105 between the rotational path of the teeth 108 of set 108A. The teeth 108 of set 108C are preferably positioned to have outermost cutting surfaces forming a six inch diameter when rotated, and are preferably positioned to be rotated through the bottom-most point of the reamer between the rotational path of the teeth 108 of set 108B. The teeth 108 of set 108D are positioned to have outermost cutting surfaces forming a 5⅞ inch diameter when rotated, and are preferably positioned to be rotated through the bottom-most point of lobe 105 between the rotational path of the teeth 108 of set 108C.

FIG. 6 illustrates lobe 105 having a drift diameter D3 of 5⅝ inches and a drill diameter D4 of 6¹⁄₁₆ inches. When rotated about the threaded axis C, but without a concentric guide or pilot, the lobe 105 may be free to rotate about its drift axis C2 and may act to side-ream the near-center portion of the dogleg in the borehole. The side-reaming action may improve the path of the wellbore instead of just opening it up to a larger diameter.

Figure 7:
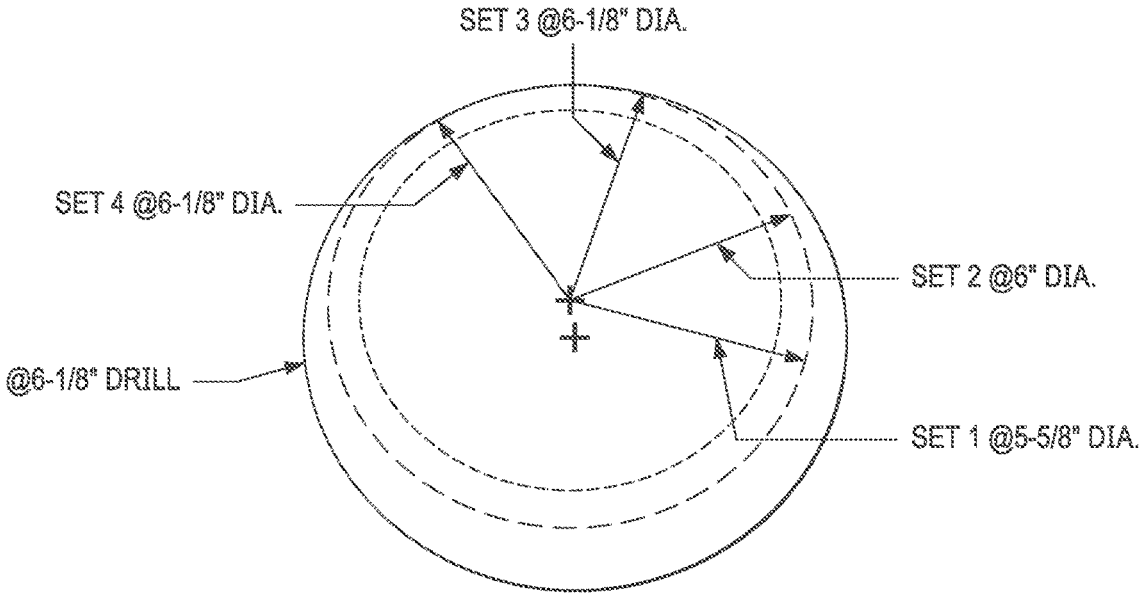
FIG. 7 illustrates the location and arrangement of Sets 1, 2, 3 and 4 of teeth on another reamer embodiment.
Figure 8:
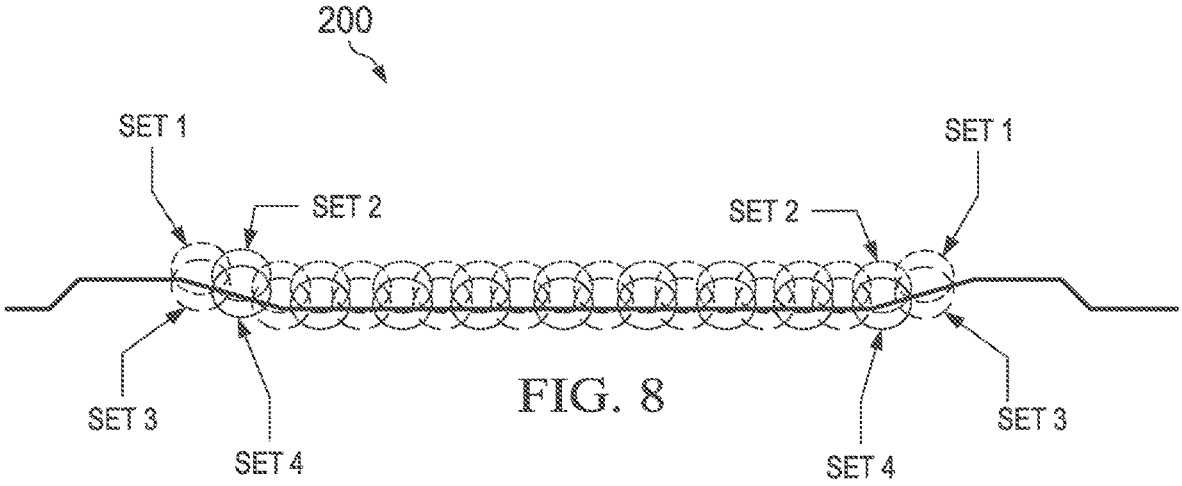
FIG. 8 illustrates the location and arrangement of Sets 1, 2, 3 and 4 of teeth on another reamer embodiment.

FIGS. 7 and 8 illustrate the location and arrangement of Sets 1, 2, 3 and 4 of teeth on another reamer embodiment 200. FIG. 7 illustrates the relative angles and cutting diameters of Sets 1, 2, 3, and 4 of teeth. As shown in FIG. 7, Sets 1, 2, 3 and 4 of teeth are each arranged to form a path of rotation having respective diameters of 5⅝ inches, 6 inches, 6⅛ inches and 6⅛ inches. FIG. 8 illustrates the relative position of the individual teeth of each of Sets 1, 2, 3 and 4 of teeth. As shown in FIG. 8, the teeth of Set 2 are preferably positioned to be rotated through the bottom-most point of the reamer between the rotational path of the teeth of Set 1. The teeth of Set 3 are preferably positioned to be rotated through the bottom-most point of the reamer between the rotational path of the teeth of Set 2. The teeth of Set 4 are preferably positioned to be rotated through the bottom-most point of the reamer between the rotational path of the teeth of Set 3.

Figure 9:
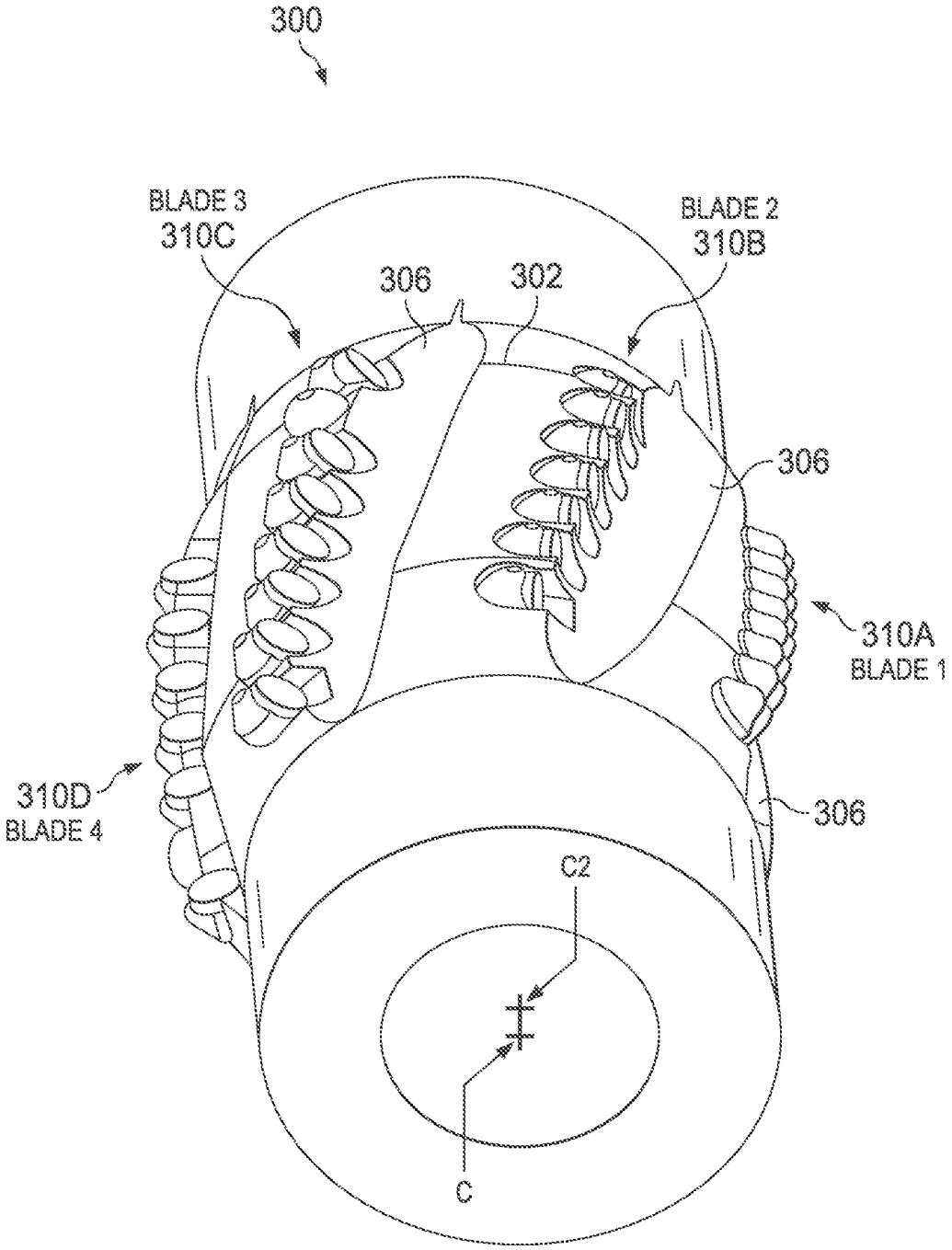
FIG. 9 is a perspective view illustrating an embodiment of a reamer having four sets of teeth.

FIG. 9 illustrates an embodiment of a reamer 300 having four sets of teeth 310, with each set 310A, 310B, 310C, and 310D arranged in a spiral orientation along a curved surface 302 having a center C2 eccentric with respect to the center C of the drill pipe on which the reamer is mounted. Adjacent and in front of each set of teeth 310 is a groove 306 formed in the surface 302 of the reamer. The grooves 306 allow fluids, such as drilling mud for example, and cuttings to flow past the reamer and away from the reamer teeth during operation. The teeth 310 of each set 310A, 310B, 310C, and 310D may form one of four "blades" for cutting away material from a near surface of a wellbore. The set 310A may form a first blade, or Blade 1. The set 310B may form a second blade, Blade 2. The set 310C may form a third blade, Blade 3. The set 310D may form a fourth blade, Blade 4. The configuration of the blades and the cutting teeth thereof may be rearranged as desired to suit particular applications, but may be arranged as follows in an exemplary embodiment.

Figure 10:
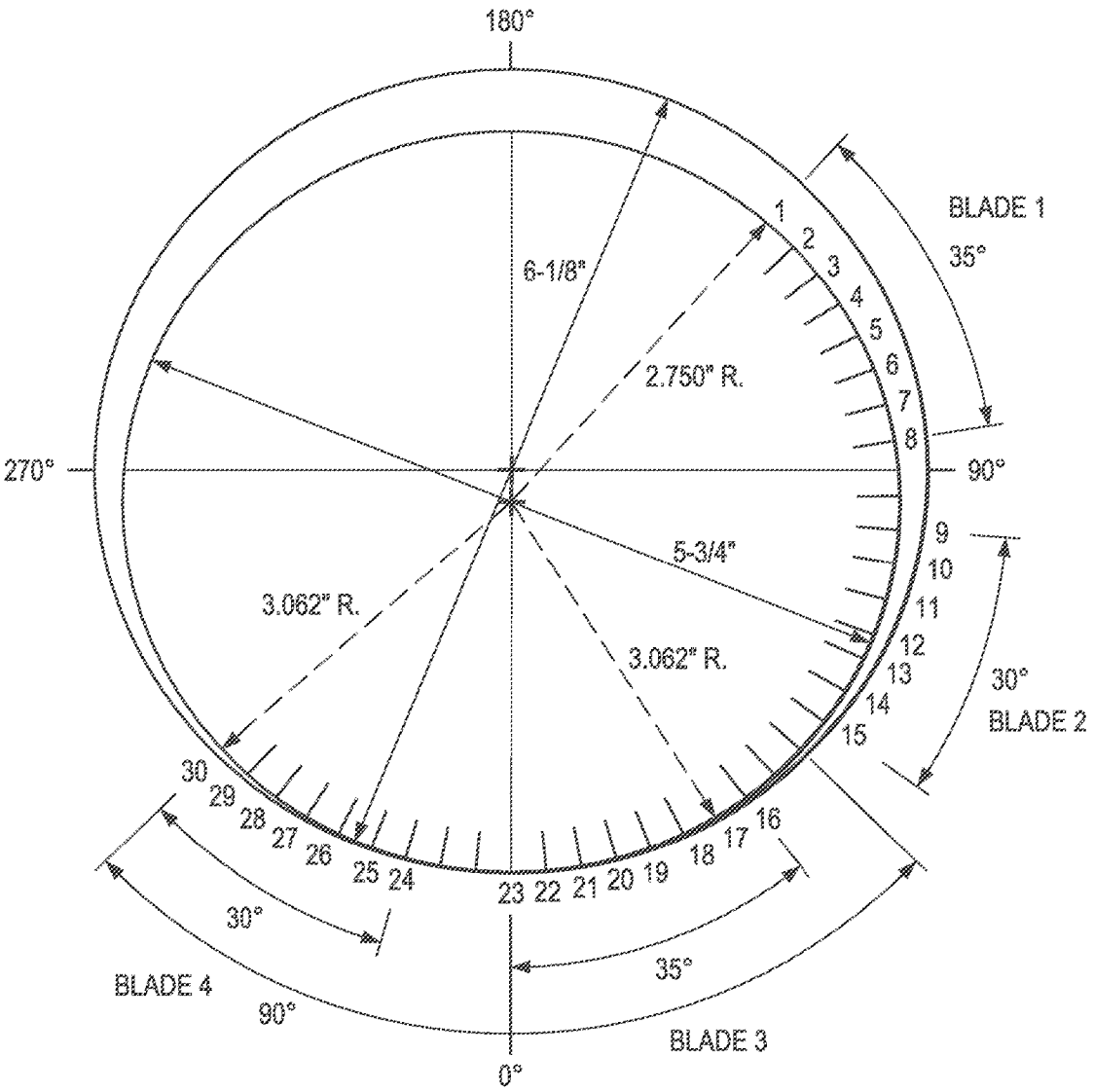
FIG. 10 is a geometric diagram illustrating the arrangement of cutting teeth on an embodiment of a reamer.
Figure 11A:
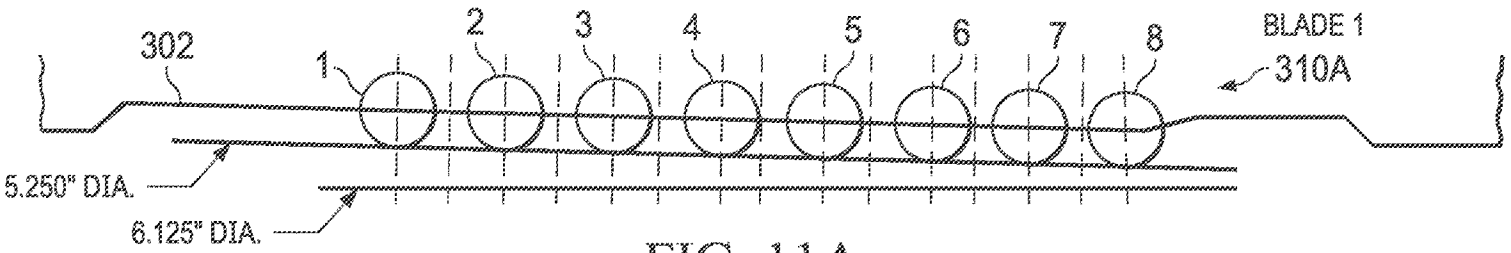
FIG. 11A-11D illustrate the location and arrangement of Blades 1, 2, 3, and 4 of cutting teeth.
Figure 11B:
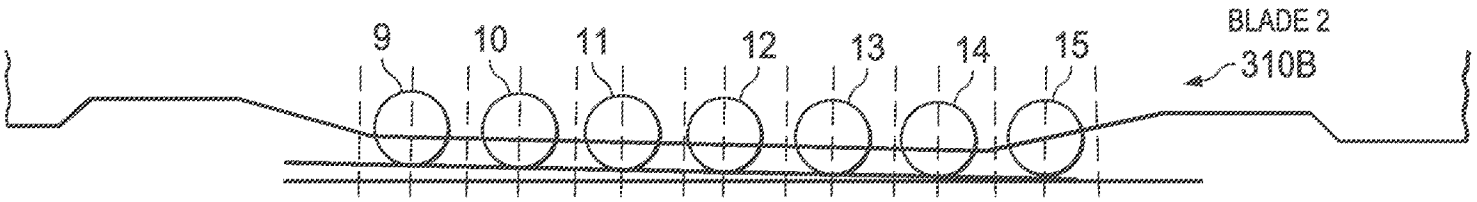
Figure 11C:
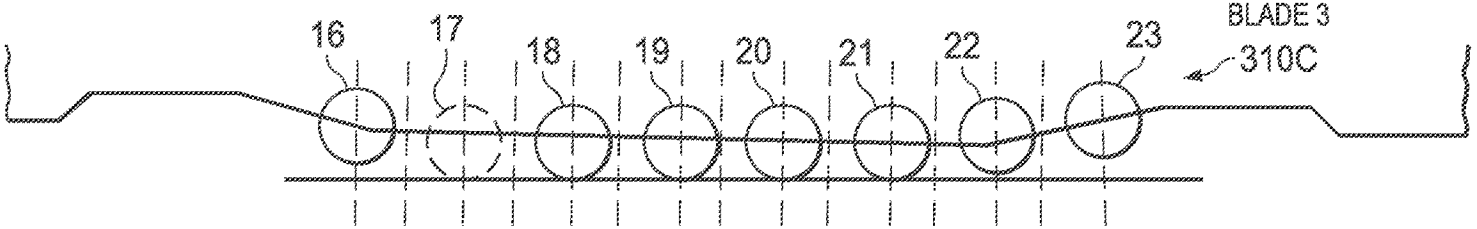
Figure 11D:
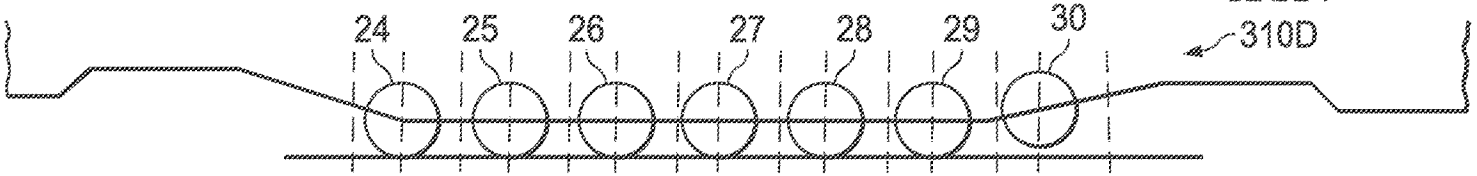

Turning now to FIG. 10, the tops of the teeth 310 in reamer 100 or 300 rotate about the threaded center of the reamer tool and may be placed at increasing radii starting with the #1 tooth at 2.750" R. The radii of the teeth may increase by 0.018" every five degrees through tooth #17 where the radii become constant at the maximum of 3.062", which corresponds to the 6⅛" maximum diameter of the reamer tool.

Turning now to FIGS. 11A-11D, the reamer tool may be designed to side-ream the near side of a directionally near horizontal wellbore that is crooked in order to straighten out the crooks. As shown in FIGS. 11A-11D, 30 cutting teeth numbered 1 through 30 may be distributed among Sets 310A, 310B, 310C, and 310D of cutting teeth forming four blades. As plotted in FIG. 10, the cutting teeth numbered 1 through 8 may form Blade 1, the cutting teeth numbered 9 through 15 may form Blade 2, the cutting teeth numbered 16 through 23 may form Blade 3, and the cutting teeth numbered 24 through 30 may form Blade 4. As the 5¼" body 302 of the reamer is preferably pulled into the near side of the crook, the cut of the rotating reamer 300 may be forced to rotate about the threaded center of the body and cut an increasingly larger radius into just the near side of the crook without cutting the opposite side. This cutting action may act to straighten the crooked hole without following the original bore path.

Figure 12:
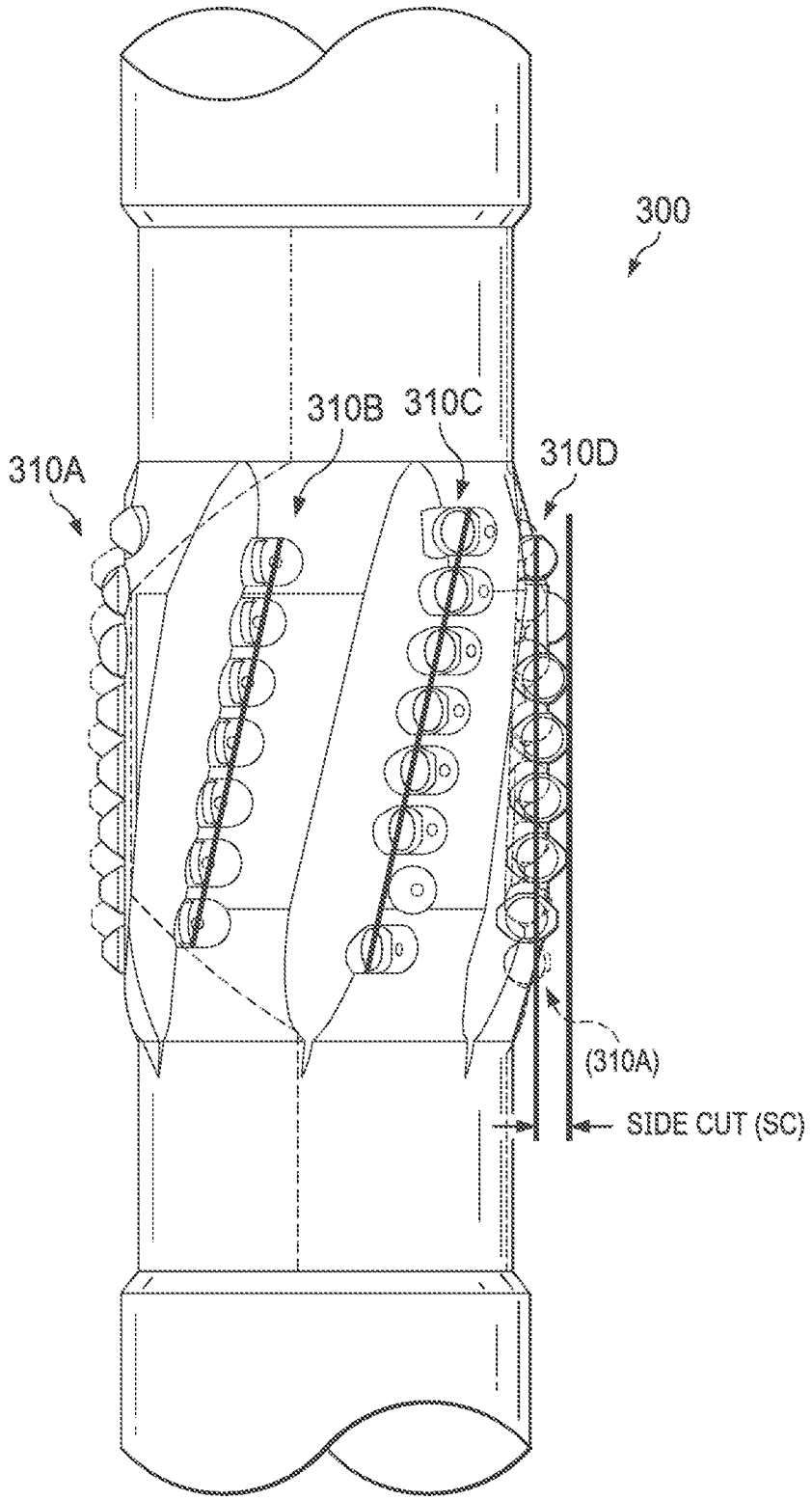
FIG. 12 is a side view of a reamer tool showing the cutting teeth and illustrating a side cut area.

Turning now to FIG. 12, the reamer 300 is shown with the teeth 310A of Blade 1 on the left-hand side of the reamer 300 as shown, with the teeth 310B of Blade 2 following behind to the right of Blade 1, the teeth 310C of Blade 3 following behind and to the right of Blade 2, and the teeth 310D of Blade 4 following behind and to the right of Blade 3. The teeth 310A of Blade 1 are also shown in phantom, representing the position of teeth 310A of Blade 1 compared to the position of teeth 310D of Blade 4 on the right-hand side of the reamer 300, and at a position representing the "Side Cut" made by the eccentric reamer 300.

Figure 13D:
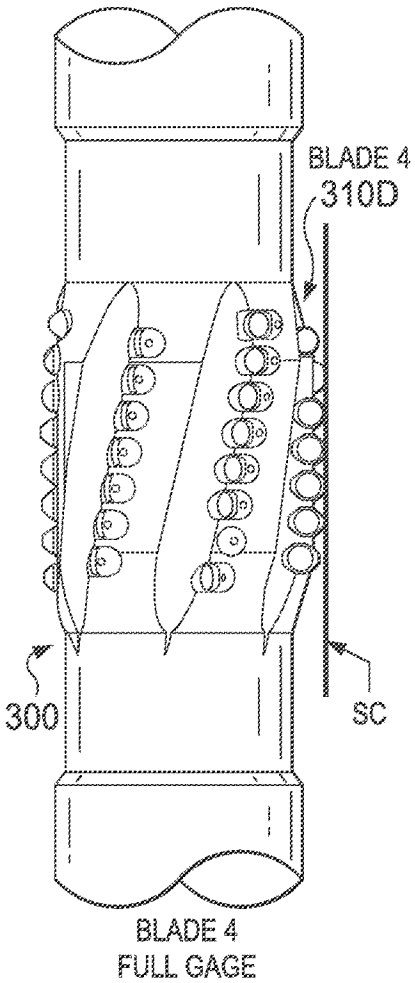
FIGS. 13A-13D are side views of a reamer tool showing the cutting teeth and illustrating a sequence of Blades 1, 2, 3, and 4 coming into the side cut area and the reamer tool rotates.
Figure 13C:
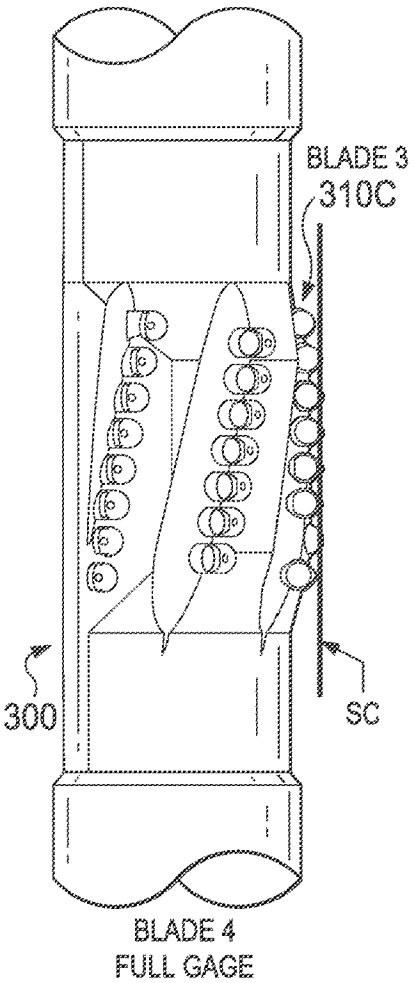
Figure 13B:
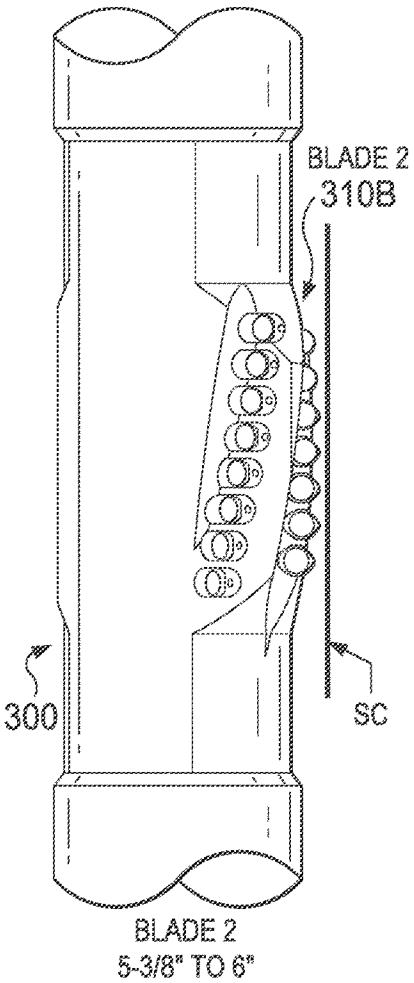
Figure 13A:
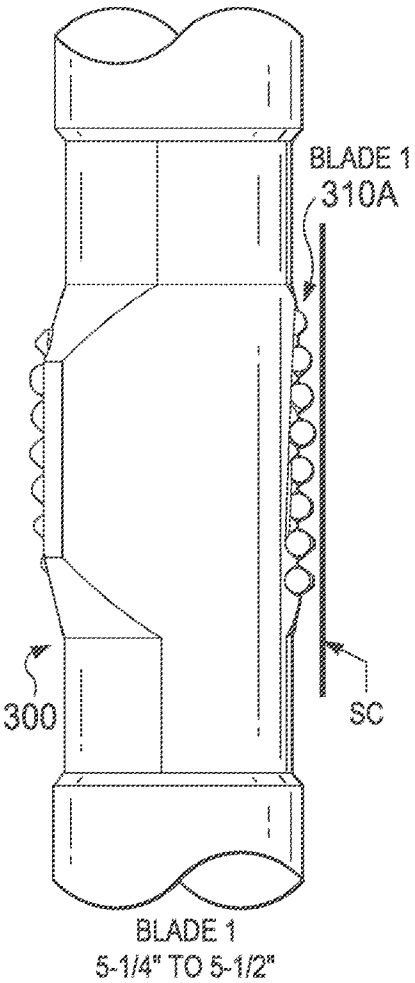

Turning now to FIGS. 13A-13D, the extent of each of Blade 1, Blade 2, Blade 3, and Blade 4 is shown in a separate figure. In each of FIGS. 13A-13D, the reamer 300 is shown rotated to a different position, bringing a different blade into the "Side Cut" position SC, such that the sequence of views 13A-13D illustrate the sequence of blades coming into cutting contact with a near surface of a wellbore. In FIG. 13A, Blade 1 is shown to cut from a 5¼" diameter to a 5½" diameter, but less than a full-gage cut. In FIG. 13B, Blade 2 is shown to cut from a 5⅜" diameter to a 6" diameter, which is still less than a full-gage cut. FIG. 13C, Blade 3 is shown to cut a "Full Gage" diameter, which may be equal to 6⅛" in an embodiment. In FIG. 13D, Blade 4 is shown to cut a "Full gage" diameter, which may be equal to 6⅛" in an embodiment.

The location and arrangement of Sets of teeth on an embodiment of a reamer as described above, and teeth within each set, may be rearranged to suit particular applications. For example, the alignment of the Sets of teeth relative to the centerline of the drill pipe, the distance between teeth and Sets of teeth, the diameter of rotational path of the teeth, number of teeth and Sets of teeth, shape and eccentricity of the reamer surface holding the teeth and the like may be varied.

Returning to FIG. 1, when the force from the whirl is transferred to roller 110, reamer 105 does not dig in and drive the tool around the rest of the rotation. Instead, roller 110 lets the tool body rotate through until lobe 105's teeth reengage. Breaking the cycle will ultimately preferably prevent whirl, reduce teeth damage, and keep the teeth engaged more continuously. Roller 110 is preferably mounted on ball bearings, plain bearings, or other suitable mechanism to permit free rotation. In other embodiments, roller 110 does not move relative to reamer 100. Modifying the spacing between the front lobe and the roller is one way that cutter radial pressure can be controlled, and this spacing can be optimized for various tool sizes and applications.

Roller 110 is preferably eccentric to the tool body and provides opposing force to the lobe 105, providing proper radial pressure to teeth 108. The eccentricity may be on the same side of reamer 100 as the lobe 105, opposite to lobe 105, or at another location about reamer 100. For example, roller 100 is preferably mounted 180 degrees opposing the tallest blade of lobe 105, but alternative alignments may be utilized for specific effect. Roller 110 preferably encompasses the entire circumference of the reamer 100, providing contact surfaces 360° around reamer 100. In other embodiments, roller 110 may only encompass a portion of the circumference of reamer 100. The tool joint on the end of reamer 100 with roller 110 is preferably eccentric to the tool body to preserve and enhance the pass thru ability for a given size of tool. Roller 110 may have recesses to allow drilling fluid and waste to pass around roller 110.

Lobe 105 preferably does the majority of the material removal in this configuration, but roller 110 can be designed to help condition the bore as roller 110 passes through. Roller 110 preferably has a wear resistant coating with various textures that abrade the rock, or cutting inserts that work using radial pressure. In another embodiment, roller 110 can be a wear resistant material itself such as ceramic.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

We claim:

1. A reamer for increasing a diameter of a wellbore, wherein the reamer is configured to be coupled to a drill string with a center of rotation, comprising:

a reamer lobe including at least one cutting blade, the at least one cutting blade including a plurality of cutting teeth, wherein a center of the teeth are eccentrically displaced from the center of rotation of the drill string when the reamer is coupled to the drill string; and a roller with a center eccentrically displaced from the center of rotation of the drill string when the reamer is coupled to the drill string, the roller being spaced from the reamer lobe, the roller being configured to rotate relative to the reamer, wherein the roller encompasses a circumference of the reamer.

2. The reamer of claim 1, wherein the reamer lobe is positioned to urge the at least one cutting blade into engagement with a surface of the wellbore nearest a center of drift of the wellbore.

3. The reamer of claim 1, wherein the roller is adapted to provide an opposing force to a force acting on the reamer lobe.

4. The reamer of claim 1, wherein the at least one cutting blade comprises a plurality of cutting blades, wherein each blade of the plurality of cutting blades comprises a plurality of cutting teeth.

5. The reamer of claim 4, wherein the plurality of cutting teeth extend tangentially to the reamer.

6. The reamer of claim 4, wherein each cutting tooth of the plurality of cutting teeth of each of the plurality of cutting blades is offset from another tooth of an adjacent cutting blade.

7. The reamer of claim 4, wherein each cutting tooth of the plurality of cutting teeth is comprised of carbide or diamond.

8. The reamer of claim 4, wherein the plurality of cutting teeth face a direction of rotation.

9. The reamer of claim 4, wherein the plurality of cutting teeth of each of the plurality of cutting blades are longitudinally overlapping from the plurality of cutting teeth of an adjacent cutting blade.

10. The reamer of claim 4, wherein each of the plurality of cutting blades extends along a spiral path on a portion of an outer surface of the reamer lobe, wherein the spiral path traverses an acute angle relative to a longitudinal axis of the reamer.

11. The reamer of claim 4, wherein each of the plurality of cutting blades extends parallel or at an angle to an axis of the reamer.

12. The reamer of claim 1, wherein the reamer lobe and the roller are configured to work in conjunction to limit whirl during drilling.

13. The reamer of claim 1, wherein the roller is comprised of an abrasive material.

14. The reamer of claim 1, wherein the roller further comprises grooves in an outer surface of the roller.

15. The reamer of claim 1, wherein the roller is mounted 180 degrees opposing the reamer lobe.

16. A drill string with a center of rotation, comprising:

a bottom hole assembly; and a reamer coupled to the drill string, the reamer comprising:

a reamer lobe including at least one cutting blade, the at least one cutting blade including a plurality of cutting teeth, wherein a center of the teeth are eccentrically displaced from the center of rotation of the drill string; and a roller with a center eccentrically displaced from the center of rotation of the drill string, the roller being spaced from the reamer lobe, the roller being configured to rotate relative to the reamer, wherein the roller encompasses a circumference of the reamer.

17. The drill string of claim 16, wherein the reamer is positioned at least 100 feet behind the bottom hole assembly.

18. The drill string of claim 16, wherein the bottom hole assembly comprises a drill bit.

19. The drill string of claim 16, wherein the reamer lobe is positioned to urge the at least one cutting blade into engagement with a surface of a wellbore nearest a center of drift of the wellbore.

20. The drill string of claim 16, wherein the reamer lobe and the roller are configured to work in conjunction to limit whirl during drilling.

* * * * *